US005699051A

United States Patent [19]

Billig et al.

[11] Patent Number: 5,699,051

[45] Date of Patent: Dec. 16, 1997

[54] LOAD MONITORING ELECTRICAL OUTLET SYSTEM

[76] Inventors: Richard R. Billig, One Bayview #12, Los Gatos, Calif. 95030; Steven B. Carlson, 11929 NW. Old Quarry Rd., Portland, Oreg. 97229

[21] Appl. No.: 687,919

[22] Filed: Jul. 29, 1996

[51] Int. Cl.[6] ..... G08B 17/10

[52] U.S. Cl. ..... 340/657; 340/656; 363/146; 439/490

[58] Field of Search ..... 340/654, 656, 340/657, 660, 662, 664; 324/86, 133, 508, 509; 439/488, 489, 490; 363/146

[56] References Cited

U.S. PATENT DOCUMENTS

| | | | |
|---|---|---|---|
| 4,418,979 | 12/1983 | Takashima | 439/490 |
| 4,659,161 | 4/1987 | Holcomb | 439/490 |
| 4,875,152 | 10/1989 | Foster | 340/656 |
| 4,885,532 | 12/1989 | Macey | 340/654 |
| 5,003,486 | 3/1991 | Hendel et al. | 340/656 |
| 5,514,964 | 5/1996 | Benesh et al. | 324/509 |

OTHER PUBLICATIONS

Gerald L. Kmetz, "Designing Copper–Trace Resistors", *Electronic Design*, May 13, 1996, p. 103.

Joseph L. Sousa, "Four transistors measure rms power" *EDN*, Jan. 7, 1993, p. 102.

"Omega: Power Analysis in a New Light" brochure from Reliable Power Meters, Los Gatos, CA, 1993, pp. 1–8.

"Super Matched Bipolar Transistor Pair Sets New Standards for Drift and Noise" National Semiconductor Application Note 222, Jul. 1979, pp. 1–10.

"Energy$Teller can be the best customer relations tool you ever had!" brochure from Energy Teller, Inc. (undated), six pages.

"Power Watch" brochure from ACR Systems, Inc. undated, four pages.

"Power and Power Quality Measurements" AEMC Instruments, Boston, MA, 1995, pp. 1–35 and covers.

*Primary Examiner*—Jeffery Hofsass
*Assistant Examiner*—Timothy Edwards, Jr.
*Attorney, Agent, or Firm*—Clifton L. Anderson

[57] ABSTRACT

A branch circuit includes an branch breaker, a master outlet, and two slave outlets in series with the master outlet. The master outlet is the closest of the outlets to the circuit breaker. It includes a power sensor, the output of which is graphically displayed on a multi-segment LED display visible from the front of the outlet. The power sensor output is also supplied to displays at the slave outlets so that the power measured at master outlet is indicated at all outlets. This allows the available power capacity for the branch circuit to be appropriately indicated at all outlets on the circuit. The design can be implemented inexpensively enough that it is economical to employ the invention at every outlet in a building.

5 Claims, 3 Drawing Sheets

LOAD MONITORING ELECTRICAL OUTLET SYSTEM

BACKGROUND OF THE INVENTION

The present invention relates to electrical systems and, more particularly, to electrical outlets with associated power monitoring systems. A major objective of the present invention is to provide for convenient and economical monitoring of electrical usage to promote effective energy budgeting.

Power consumption by user-connectable devices ("plug loads") is growing rapidly. The explosion in the number of personal computer users has greatly increased the electrical power requirements per person, particularly in the commercial sector. This increase has been exacerbated by the trends toward larger cathode-ray tube (CRT) displays and laser printers (which can have peak power requirements over 1000 watts). The increased power requirements have not only strained total available electrical capacity, but also the capacity of electrical distribution systems to allocate the power to the multiple locations within a commercial building.

Most commercial buildings distribute electricity to electrical outlets so that electricity can be supplied to a device by plugging its power cord into one of these outlets. Electricity is distributed to the outlets by branch circuits. Each of these branch circuits may supply one or more outlets. Most outlets provide two sockets, but extension cords and adapters are readily available that expand the number of sockets per outlet.

Each of the branch circuits is limited in the power it can supply without damaging itself or its surroundings. The limit is determined at the time of installation, for example, by selecting the conductor diameter (gauge); circuit breakers are provided for each branch circuit to prevent damage in case the capacity is exceeded for an excessive duration. Greater capacity branch circuits are considerably more expensive than lower capacity circuits. Accordingly, it is economical to allocate branch circuit capacity according to expected usage.

Most existing commercial buildings were built before the personal computer era. With the widespread introductions of computers and their peripherals, expected usages have been severely exceeded. It has become more likely that the next device to be plugged in will cause an overload condition. Even a single device plugged into an otherwise unused outlet can lead to an overload condition in a branch circuit servicing other heavily used outlets. Such overload conditions can be hard to anticipate, because it is not in general apparent to a person plugging in a device into an outlet what other outlets are on the same branch circuit.

In the event that a prolonged overload condition causes a circuit breaker to "trip", hours of work may be lost as the sudden loss of power results in data loss and/or corruption. In the commercial sector, access to circuit breakers is typically limited, so maintenance personnel must be contacted to reset the circuit breaker. In the meantime, the productivity of employees is curtailed while offending equipment is identified and removed and the circuit breaker is reset.

Furthermore, an increasing percentage of loads are non-linear, in that their load impedance changes with the applied voltage. When several non-linear loads are plugged into a branch circuit, the third harmonic components can add in the neutral line of a three-phase circuit. This combination can cause overheating and lead to fire. Even when a fire safety issue is not present, a heavily-loaded circuit with loads that change their demand behavior over time can cause sensitive equipment to malfunction. For example, voltage sags engendered by periodic high-current demands of devices such as laser printers may adversely affect other appliances on the same circuit, if their internal power supplies have not been designed to anticipate such a sag condition.

An individual business can address the electrical shortage by upgrading an existing electrical distribution system. This can be expensive in an older building in which the wiring is buried in walls, floors, and ceilings. Another option is to move to a more modern building with greater electrical distribution capacity and which can have wiring located behind removable panels for more ready upgrading.

Such solutions are expensive and unsatisfactory on a community-wide basis. Widespread upgrading imposes increasing demands on electrical power utility companies. These utilities are constrained, partly by environmental concerns, from expanding to meet the increased demand for electricity. Accordingly, utilities must implement pricing policies that discourage increased usage. Ultimately, such limits on available power reduce the cost-effectiveness of high-capacity electrical installations and upgrades. Thus, the problem of near-capacity use of electrical systems has become an ongoing concern.

Electrical supply limitations are forcing companies to manage their demand for electricity by reducing demand or shifting some demand to non-peak usage times. Systems have been developed for monitoring and recording electrical meter readings. The resulting information can be used by a company in setting usage policies. Although many devices are available to measure the power consumed by a branch circuit, or by an individual appliance, they are generally designed either for permanent installation at the branch circuit breaker panel, inaccessible to the user who is introducing new plug loads, or intended for portable diagnostic usage (e.g., power quality analysis tools) to diagnose a particular problem. In either case, the devices typically sell for hundreds to thousands of dollars each, making their broad use economically impossible. Thus, while such approaches have encouraged some demand reduction, there remains considerable room for improvement.

SUMMARY OF THE INVENTION

The present invention provides for a graphic display of power consumption at an electrical outlet. A person plugging in a device is immediately apprised of the present power consumption relative to some predetermined maximum. Thus, the person can determine whether the device to be connected can be used safely. In addition, the display can be used to monitor the consumption pattern of connected devices. If there is a problem with the electrical functioning of a connected device, the display can be referenced to determine if circuit overload might be a contributing factor.

Accordingly, the outlet system includes at least one connector, e.g., socket, to which a device can be connected, e.g., via a plug. A graphical display is held in a fixed position near (within ten centimeters) of the connector. The graphical display indicates power according to a spatial light distribution. At least three distributions are provided indicating three different power consumption levels: "off" or other minimum level, one indicating "overload" or other maximum level, and at least one intermediate level. For example, the display can be a multi-segment light-emitting diode (LED) display. Associated with the display is a suitable display driver for converting the power signal to LED control signals.

The outlet system includes a power sensing circuit that outputs a signal indicating the power being consumed by loads on the branch circuit. Power can be determined by multiplying voltage between power and neutral lines by current though the line-level line. The multiplication can be performed by a bank of transistors. In the process of bringing the supply currents and voltages within the linear ranges of the transistors, the sensing circuit converts the supply voltage to a current and the line current to a voltage. Economically, the resistor that converts the line current to a voltage can be a trace on a circuit board on which other sensing circuit components are mounted. The currents resulting from the conversion are applied to transistor emitters, while the voltages resulting from the conversions are applied to transistor bases. The resulting collector currents approximate the product of base voltage and emitter current.

In the preferred embodiment, separate product currents are generated for the positive-going and negative-going half cycles of the supply voltage. These product currents are converted to voltages that are in turn fed to respective inputs of a differential amplifier. The output of the differential amplifier is the power-indication signal. The power-indication signal is transmitted to the display driver so that the power consumed by the load is represented on the display.

Where outlets at different locations are supplied by a common branch circuit, an outlet can be set so that its maximum display output corresponds to an allotted fraction of the power supplied by the branch circuit. Two multiple-outlet configurations can be considered: "ordered" configurations in which the "hot" lines of the outlets are in series, and "sub-branched" configurations in which the hot lines of the outlets are connected to a common branch breaker via separate sub-branch lines. In the sub-branched configuration, it may be expedient have the maximum reading of the outlets' displays correspond to equal fractions of the power capacity of the branch circuit.

The ordered configuration has the characteristic that each outlet is subject not only to the loads of devices plugged into it, but to those of devices connected to downstream outlets. For outlets in an ordered configuration, a power sensor at the outlet electrically nearest to the breaker indicates the load on all outlets in the series. However, loads at the nearest location are not sensed by power sensing circuits at the more remote outlets. Where it is desired that the total power consumed by all outlets in an ordered configuration be represented at each outlet, the present invention provides for a master-slave configuration.

The master includes, in addition to the above-described elements, a buffer for amplifying the power-indication signal. The output of this buffer is not applied to the display driver. Instead it is used to transmit the power-indication signal to a slave outlet. The slave outlet uses the master power-indication signal to drive the slave display so that the power consumption measured at the master outlet is displayed at the slave outlet. It should be noted that the power-indication signal can also be used to drive other remote displays, for example, at more convenient viewing locations. In addition it can be made available for recording and device control.

The present invention provides for real-time measurement and display of power being consumed on an electrical circuit. Thus, available circuit capacity can be displayed at each place where new loads can be introduced into the circuit. The invention can be implemented sufficiently inexpensively that it is economically advantageous to implement the monitoring function at all connection points. Every time a person endeavors to plug in a device, that person is apprised of the electrical usage associated with that outlet.

In addition, a person can refer to the outlet display to assess the power consumption characteristics of an attached device. For example, some laser printers, during idle periods, occasionally enter brief heating cycles to reheat the toner fuser. Monitoring a power consumption display can make a device user aware of such a power consumption plan and its potential affect on the branch circuit to which it is connected.

Apprised of the power-consumption data, a person is in a much better position to make intelligent choices that favor conservation of electrical power. This can reduce business costs, reduce excess demand on public utilities, and promote conservation. Display of power consumption at each outlet may also serve as a reminder to unplug or turn off unnecessary loads. These and other features and advantages are apparent from the description below with reference to the following drawings.

DESCRIPTION OF THE PREFERRED EMBODIMENTS

Figure 1:
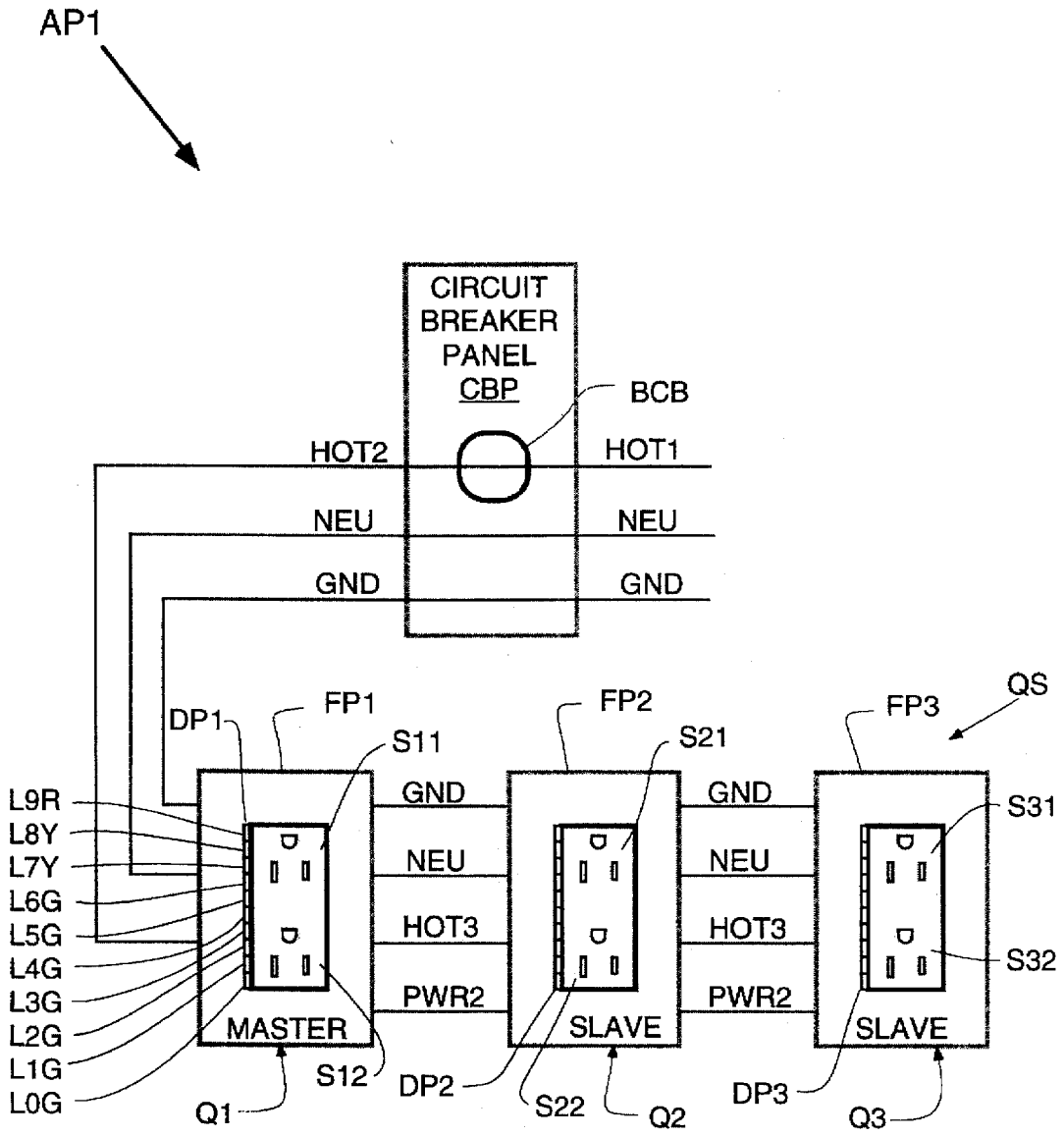
FIG. 1 is a schematic diagram of a branch circuit incorporating outlet systems in accordance with the present invention.

A branch circuit AP1 incorporating the present invention includes a circuit breaker panel CBP and an outlet system QS, as shown in FIG. 1. Outlet system QS includes a master outlet Q1 and two slave outlets Q2 and Q3. Circuit breaker panel CBP has inputs for external ground GND, neutral NEU, and hot HOT1. Ground GND and neutral NEU are passed to outlet system QS. Circuit breaker panel CBP includes a branch circuit breaker BCB, which shorts external hot HOT1 with branch hot HOT2, which is provided to outlet system QS. Nominally 20A branch circuit breaker BCB is designed to open when a characteristic condition expressed in terms of overload and duration is exceeded.

Master outlet Q1 passes GND and NEU and provides hot line HOT2 to slave outlets Q2 and Q3. In addition, master outlet Q1 provides a power-indication signal PWR2 to slave outlets Q2 and Q3 so that all three outlet displays DP1, DP2, and DP3 indicate the same total branch circuit load. Each outlet includes a pair of outlet sockets S11-S12, S21-S22, S31-S32, a multi-segment display DP1, DP2, DP3, and a face plate FP1, FP2, FP3.

Figure 2:
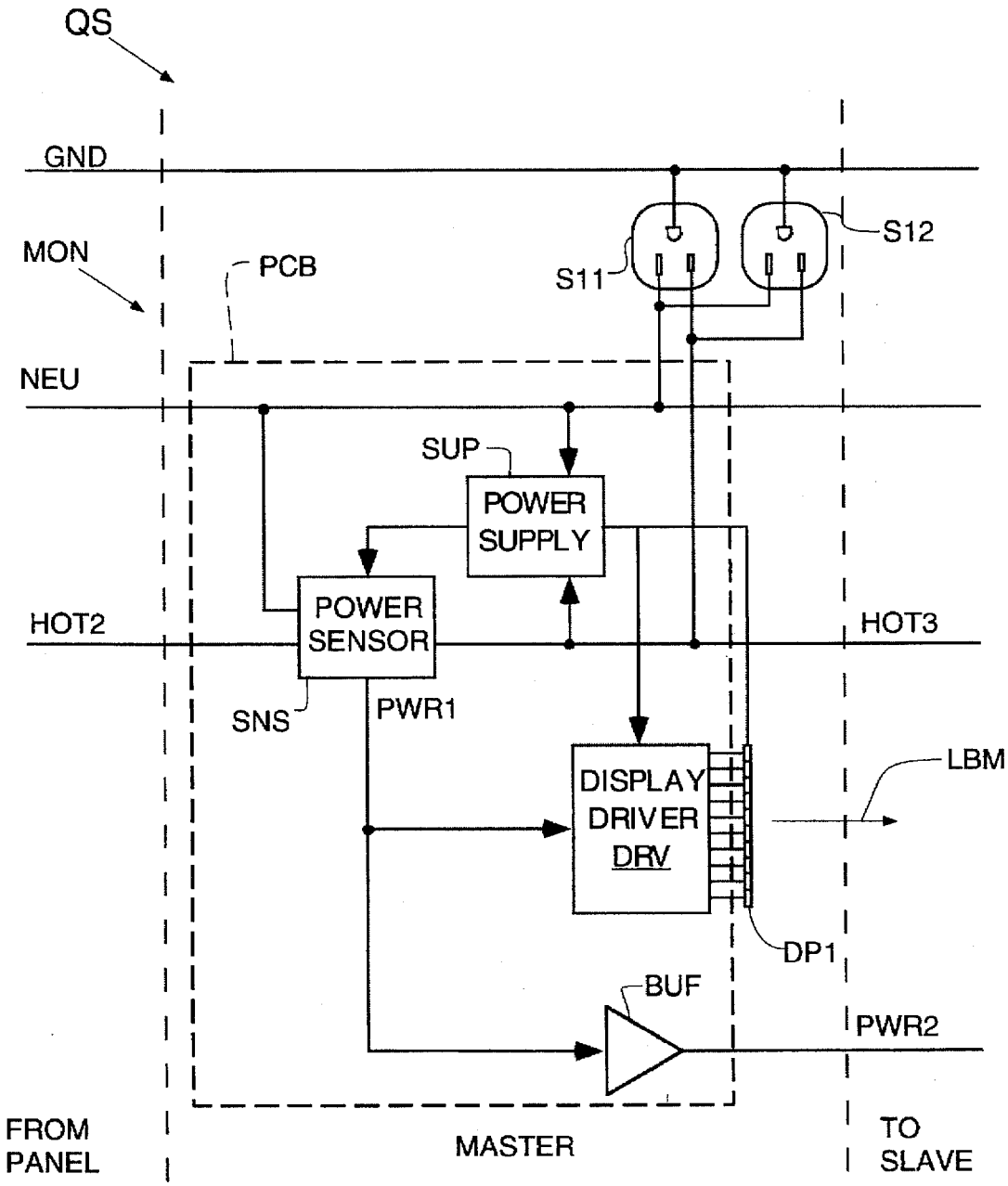
FIG. 2 is a schematic diagram of a master outlet system incorporated in the electrical supply circuit of FIG. 1.

Master outlet Q1 further includes a power-monitoring system MON including a power supply SUP, a power sensor SNS, a display driver DRV, and a buffer BUF, as shown in FIG. 2. Each of the first three of these elements includes a corresponding integrated circuit and associated discrete components. These are all mounted on a printed circuit board PCB that provides suitable interconnection among the integrated and discrete electrical components. Display DP1 is mounted so that its emissions are directed, in the direction of arrow LBM, off an edge of printed circuit board PCB. Printed circuit board PCB is mounted perpendicular to face plate FP1 so that display DP1 is visible from the front of outlet Q1, as shown in FIG. 1. Displays DP2 and DP3 are similarly arranged relative to respective printed circuit boards and face plates.

Power supply SUP receives NEU and HOT2 as inputs and provides +3 V and −3 V as outputs to power sensor SNS, display driver DRV, and display DP1. Power supply SUP includes two sections, one for providing a positive +3 V, and one for providing a negative −3 V. Each section consists of a resistor, a series blocking capacitor, a diode, a Zener diode and a filter capacitor. Line NEU is connected through a series limiting resistance of about 100 ohms. This value may be changed to adjust the amount of inrush current allowed when initially charging up the power supply capacitor. The output of the resistors is connected to a high voltage, 400 VDC, Mylar dielectric capacitor. This capacitor forms the impedance to drop the line voltage to the Zener voltage value. The series diode provides rectification and the electrolytic capacitor provides energy storage. In this embodiment the voltages are ±3 VDC. Power supply SUP is not illustrated in detail because it is conventional and many other power supply topologies are possible.

Display DP1, like display DP2 and DP3, is a linear ten segment LED array mounted on the edge of printed circuit board PCB. From bottom to top, there are seven green segments LOG, L1G, L2G, L3G, L4G, L5G, L6G, two yellow segments L7Y, L8Y, and one red segment L9R. Display driver DRV includes an integrated circuit LM3914 from National Semiconductor. This driver is configured (by the connections at its inputs) so that only one of the display segments lights at a time and power consumption is minimized. Driver DRV receives the power-indication signal PWR1 and lights a respective LED segment accordingly.

Figure 3:
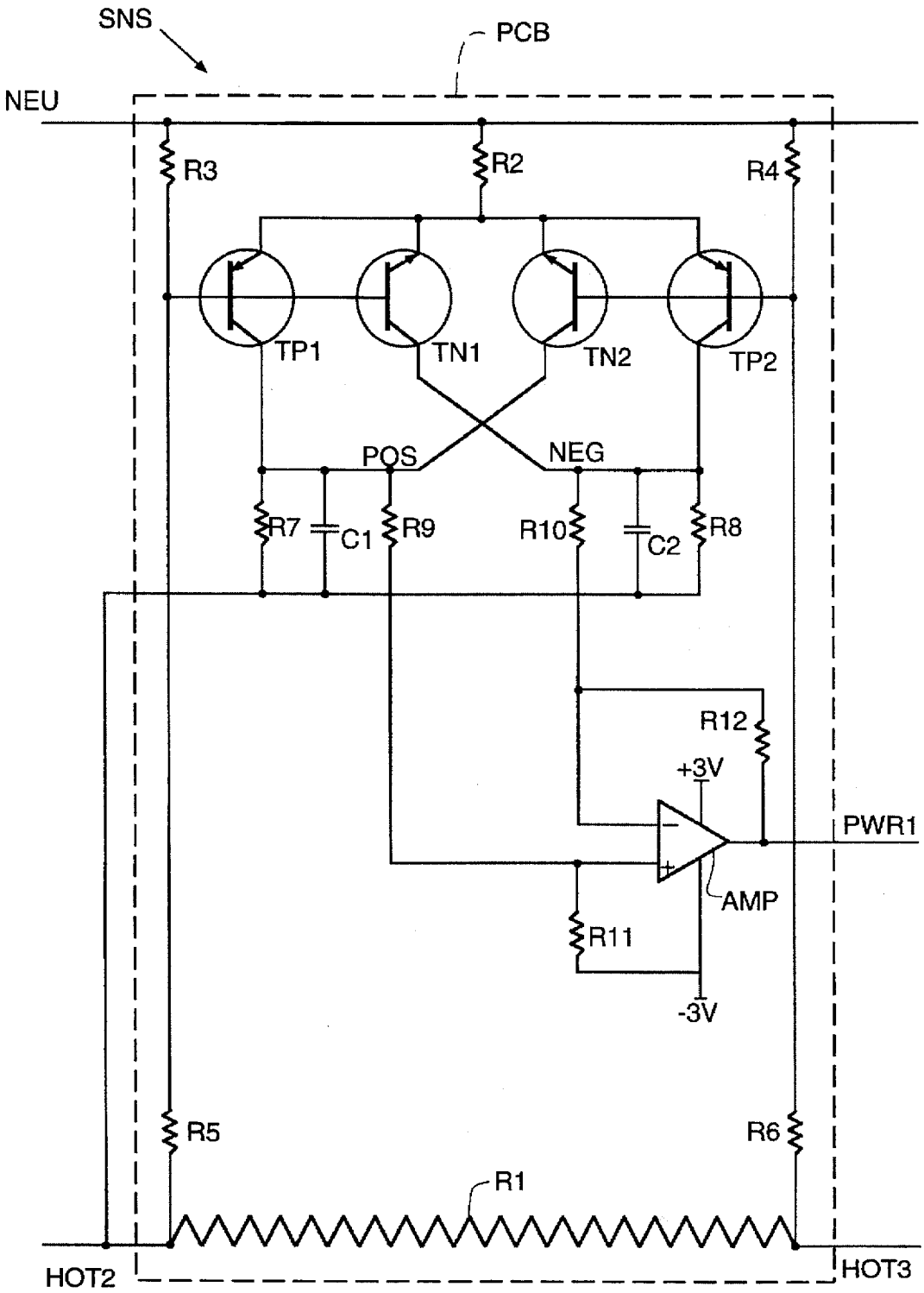
FIG. 3 is a circuit diagram of a power-sensing circuit of the master outlet system of FIG. 2.

Power sensor SNS provides a power indication signal PWR1 that is directed to display driver DRV and a buffered power-indication signal replica PWR2 that is directed to display drivers for slave outlets Q2 and Q3. Power can be computed by taking the product of voltage and current. The multiplication is performed by two pairs of matched bipolar transistors TP1, TP2 and TN1, TN2, shown in FIG. 3. PNP transistors TP1 and TP2 perform the multiplication during a positive-going alternating current (AC) half cycle, while NPN transistors TN1 and TN2 perform the multiplication during the negative-going AC half cycle. Illustrated power sensor SNS draws upon the teachings of Joseph L. Sousa, "Four Transistors Measure RMS Power." *EDN* Jan. 7, 1993: 102. "Super Matched Bipolar Transistor Pair Sets New Standards for Drift and Noise" Application Note 222, National Semiconductor Corporation, July 1979 describes applications for such a set of bipolar transistors.

Resistor R1 converts the output load current into a voltage differential that is applied to the bases of the transistors. Resistor R1 is a 1.3 mΩKelvin-connected resistor formed as a trace on printed circuit board PCB, as taught in Gerald L. Kmetz, "Designing Copper-Trace Resistors." *Electronic Design May* 13, 1996: 103. The drop across the shunt resistor R1 is kept within ±50 mV. Resistor R2 converts the supply voltage into an emitter current. Resistors R2, R3, and R4 are 1.0 MΩ.

Resistor R3 forms a voltage divider with 50 Ω resistor R5 to bias the bases of transistors TP1 and TN1 relative to HOT2; likewise, resistor R4 forms a voltage divider with 50 Ω resistor R6 to bias the bases of transistors TP2 and TN2 proportional to the current through resistor R1. The ratios of the current shunt resistor R1, voltage tail resistors R5 and R6 and collector load resistors R7 and R8 keep the circuit in the linear region. The 1 MΩ/50 Ω networks act as a dynamic output null adjustment, obviating a requirement for a DC offset canceling circuit.

During a positive half cycle, current through resistor R2 flows through transistors TP1 and TP2. The current through transistor TP1 flows through resistor R7, establishing a voltage differential at line POS relative to the line voltage at HOT2. The current through transistor TP2 flows through resistor R8, establishing a voltage differential at line NEG relative to the line voltage at HOT2. The voltage across the 3.3 kΩ resistors R7 and R8 is kept below 400 mV; resistors R7 and R8 provide a scale of 10 watts per millivolt. The voltage differential between lines POS and NEG is proportional to the supply voltage between lines NEU and HOT2 times the current through resistor R1, which product is the instantaneous RMS power consumed by the loads on the supply circuit.

Resistors R7 and R8 cause voltages at POS and NEG to be positive and negative offsets from the AC line voltage. Resistors R7 and R8 are 3.3 kΩ. Resistors R2 through R8 are all rated at 0.25 watts. 10 μF capacitors C1 and C2 suppress output voltage peaks to prevent transistors TP1, TP2, TN1 and TN2 from being forward biased.

The small POS and NEG signals from the RMS section are amplified by a differential amplifier circuit. The differential amp level shifts the signals to swing between the −3 VDC supply and the +3 VDC supply. The gain of the amp may be adjusted to give any desired output voltage swing that is within the range of the amplifier. In this case full scale is 1.25 VDC. The amplifier gain and the driver are co-adjusted so that red LED L9R is illuminated when the instantaneous as-measured load power reaches a maximum. For example, the maximum can be a power level which, if maintained, would cause 20A branch breaker BCB, FIG. 1, to open. This embodiment utilizes a standard low-power integrated-circuit operational amplifier, although many other differential amplifier configurations are possible.

The voltage at POS is applied to the positive input of a differential amplifier AMP through 100 kΩ resistor R9; the voltage at NEG is applied to the negative input of differential amplifier AMP through 100 kΩ resistor R10. Power supply SUP, FIG. 2, provides +3 V and −3 V voltages to differential amplifier AMP, FIG. 3. Resistor R9 is in a voltage divider relationship with 523 kΩ resistor R11 to bias the positive input of differential amplifier AMP relative to −3 V.

The output PWR1 of differential amplifier AMP is fed back through a 523 kΩ resistor R12, which determines the gain of differential amplifier AMP. Preferably, resistors R11 and R12 are selected so that a lit green LED indicates safe power consumption levels, a lit yellow LED indicates that capacity is limited, and a lit red LED indicates a maximum condition. The maximum condition can be a power consumption level which if maintained for excessive duration would cause the circuit breaker to open. Alternatively, a lower maximum can be set to accomplish a suitable level for power budgeting. The amplifier output PWR1 is also the input to display driver DRV, as indicated in FIG. 2.

Slaves Q2 and Q3 differ from master Q1 in that they lack a power sensor and in that their displays are controlled remotely, rather than locally. Of course, the master and slaves can be manufactured identically, with provision for setting a master or slave mode of operation. In this case, the slaves include nonfunctioning power sensors. In addition to master and slave configurations, there can be a "sole" configuration, similar to the master, but lacking the output buffer since no remote displays are driven. Outlets can be designed with different or adjustable power sensitivities to accommodate branch circuits with different capacities and branch circuits with parallel outlets. While the invention is illustrated in the context of wall outlets, the invention also provides for monitoring and displays on multi-outlet adapters and extension cords.

While RMS power is sensed in the preferred embodiment, approximately the same results can be achieved by sensing other power-related parameters. Since voltage is nominally given in commercial electrical systems, power is generally proportional to current. Thus, current can be used as an alternative to power as a parameter to monitor. While the preferred embodiment uses three integrated circuits and several discrete components, most of these could be implemented collectively in a custom integrated circuit.

The invention requires that the display be near a related outlet. In the present case, the printed circuit board supporting the display is mounted next to outlet sockets. However, there are a wide variety of alternative ways that the display can be fixed in position within 10 centimeters of an outlet connector.

In the case of a master outlet configuration, the buffered power-indication signal can be used for purposes other than driving a slave outlet display. Non-outlet displays can be provided, for example, at a more convenient location (e.g., at eye level) for monitoring. In addition, the power-indication signal can be directed to devices plugged into an outlet socket, for example, through a dedicated line in the plug. In fact the display can be integrated into a plug. The display can be in a multi-outlet adapter or extension cord. Alternatively, the signal can be converted to an infrared signal, the device being coupled with a complementary optical receiver. The signal can also be used as a control signal for such devices; for example, a device might avoid or postpone activation during peak load conditions. These and other variations upon and modifications to the preferred embodiments are provided for by the present invention, the scope of which is limited only by the following claims.

We claim:

1. A load monitoring electrical outlet system comprising:

an electrical connector for coupling electrical power to a device engaged therewith;

power sensing means for measuring a power-related parameter correlated with the power consumed by said device when engaged with said connector, said power sensing means having an output from which a power signal corresponding to the present value of said power-related parameter is transmitted;

display means for displaying a present value of said parameter at least in part as a spatial distribution of light, said display having at least a minimum spatial distribution indicating that the value of said parameter is no greater than a minimum threshold, a maximum spatial distribution indication that the value of said parameter is not less than a maximum threshold, and at least one intermediate spatial distribution indicating that the value of said parameter is between said minimum threshold and said maximum threshold, said display means being coupled to said output of said power sensing means, said display means including a display;

support means for holding said connector and said display in fixed positions relative to each other so that their minimum distance apart is not greater than ten centimeters; and a buffer for buffering said power signal, said buffer having an output for outputting a buffered power signal that is not provided to said display means.

2. A system as recited in claim 1 wherein said parameter is an rms parameter.

3. A system as recited in claim 1 further comprising a second connector, a second display means including a second display, and a second support means for holding said second connector and said second display in fixed positions relative to each other so that their minimum distance apart is not greater than ten centimeters, said second display means being coupled to said output of said buffer so that said second display displays said present value.

4. A system as recited in claim 1 wherein said power-related parameter is root-mean-square power.

5. A system as recited in claim 4 wherein said power sensing means includes a circuit board trace resister for converting a first current to a first voltage, means for converting a second voltage to a second current, and means for multiplying said first voltage by said second current to generate said power signal.

* * * * *